US005368288A

United States Patent [19]

Philipp et al.

[11] Patent Number: 5,368,288

[45] Date of Patent: Nov. 29, 1994

[54] METHOD OF AND APPARATUS FOR THE STACKING OF SHEETS

[75] Inventors: Helmut Philipp, Düsseldorf; Wilfried Kurth, Hilden, both of Germany

[73] Assignee: Jagenberg Aktiengesellschaft, Dusseldorf, Germany

[21] Appl. No.: 87,613

[22] Filed: Jul. 2, 1993

[30] Foreign Application Priority Data

Jul. 2, 1992 [DE] Germany ..... 4221660

[51] Int. Cl.[5] ..... B65H 31/12

[52] U.S. Cl. ..... 271/215; 271/218; 271/221; 414/790.8

[58] Field of Search ..... 271/210, 215, 217, 218, 271/221; 414/790.8, 790

[56] References Cited

U.S. PATENT DOCUMENTS

| | | | |
|---|---|---|---|
| 2,274,713 | 3/1942 | Kushera | 271/210 |
| 2,624,577 | 1/1953 | Peugnet | 271/210 |
| 2,733,064 | 1/1956 | Martin . | |
| 5,014,974 | 5/1991 | Jones et al. | 271/218 |
| 5,102,117 | 4/1992 | Henn et al. | 271/218 |

FOREIGN PATENT DOCUMENTS

| | | |
|---|---|---|
| 0409046A1 | 1/1991 | European Pat. Off. . |
| 2942965 | 5/1981 | Germany . |
| 2942965A1 | 5/1981 | Germany . |
| 8804066.6 | 6/1988 | Germany . |
| 3721393 | 1/1989 | Germany . |
| 3823806 | 1/1990 | Germany . |
| 3823806C2 | 1/1990 | Germany . |

*Primary Examiner*—H. Grant Skaggs
*Attorney, Agent, or Firm*—Herbert Dubno

[57] ABSTRACT

Sheets of cardboard continuously fed in a shingled stream are stacked upon a progressively lowered speed form until the desired stack height is reached, whereupon a vertically-fixed horizontal movable bar grate is inserted between the oncoming sheets and the finished stack, concurrently with vibration of the stop board against which the leading edges of the sheets impact.

6 Claims, 3 Drawing Sheets

METHOD OF AND APPARATUS FOR THE STACKING OF SHEETS

Field of the Invention

Our present invention relates to a method of stacking sheets fed in a shingled (overlapping) succession. The invention also relates to an apparatus for that purpose.

More particularly, the invention relates to the stacking of sheets on a raisable and lowerable sheet-collection platform under conditions in which a bar grate or other intermediate support can be inserted between oncoming sheets and a stack of the desired height or sheet number to accumulate a new stack or collection of such sheets adapted to form a new stack while the original stack is removed from the platform.

BACKGROUND OF THE INVENTION

Downstream of a transverse cutting or slicing machine, i.e. a cross-cutter dealing with cardboard and the like, the transversely cut sheets are generally stacked upon pallets which can be mounted on a raisable and lowerable sheet-collection platform.

In order to ensure sufficient time to allow a completed stack to be removed from the platform, German Patent 38 23 806 describes a stacking unit which utilizes a bar grate as an auxiliary stacking platform. The oncoming sheets are collected on this bar grate during the period in which the completed stack on its pallet is removed, a new pallet is placed upon the platform and this pallet is raised below the bar grate for transfer of the sheets which have collected thereon and incipiently forming a new stack onto that platform.

In the stack of cardboard sheets which can have a weight of more than 150 g/m$^2$ the bar grate can be vertically fixed at a given distance below the sheet feed plane since such sheets, unlike more sensitive paper sheets, can have a relatively long freefall without creating problems in stacking while the partial stack which newly forms upon the bar grate rises in height to the level of the feed plane, the stack removal and pallet change can be carried out.

The drawback of this process and the conventional apparatus used for that purpose is that to introduce the bar grate in the sequence of sheets which generally are fed in a shingled or overlapping pattern, a gap in the shingled stream of the sheets must be ensured. The bars of the bar grate cannot readily be moved through the stack as sheets deposit thereon. The weight of the sheets collecting on the bar grate during the insertion movement of the latter continuously increases during that movement so that at least at the last part of the insertion stroke and immediately ahead of any stop board against which the sheets impact, damage to the edges of the sheets can occur by this insertion movement.

In the past efforts have been made to avoid this drawback by partially interrupting the sheet feed and for that purpose that the movement of the sheets must be impeded somewhere is itself a major drawback.

While we consider German Patent 38 23 806 to best represent the prior art, mention can also be made of DE-OS 29 42 965 which describes a stacking arrangement, especially for printing processes which may be used to stack very thin paper sheets for signatures. In this arrangement as well, a bar grate is provided. The bars of this bar grate are provided on the outlet openings for compressed air which are directed upwardly toward the leading edges of the oncoming sheets and which thus provides an air cushion supporting the sheets and assisting in the insertion of the bar grate. This arrangement, of course, is dependent upon the continuity of supply of the compressed air.

Mention should also be made of German utility model DE GM 88 04 066 which describes a vibrator for sheet stacking machines in which a vibrating plate has at its lower end rollers with axes transverse to the vibration direction and which cooperates with a spring plate extending horizontally beneath the roller 15. The spring plate acts as a running surface for the roller with which the vibrating plate is braced against the pallet. This system does not deal with the problem of insertion of a bar grate as an intermediate stacking element during replacement of the pallet on a stacking platform.

U.S. Pat. No. 2,733,064 issued Jan. 31, 1956 to George A. Martin discloses a sheet-delivering apparatus especially sheets of tin plate and other heavy metallic sheets which utilizes a jogging device to facilitate alignment of the oncoming sheets with the sheets of the stack. Here too the problem of insertion of a bar grate between a stack and shingled sheets cardboard or the like is not dealt with.

German open application DE-OS 37 21 393 describes an apparatus for stacking sheets in conjunction with cross cutting of paper or paperboard and describes a raisable and lowerable platform upon which the pallet can be placed, as well as the bar grate which can be inserted to allow removal of the completed stack. The problem of gapping the oncoming sheets to allow insertion of the bar grate is solved in a different manner in this system.

OBJECTS OF THE INVENTION

It is, therefore, the principal object of the present invention to provide an improved method of stacking sheets, especially shingled sheets arriving from a cross-cutter and particularly cardboard sheets, whereby the drawbacks of earlier cardboard stackers are avoided and, particularly, insertion of the bar grate in the continuously accumulating descending stream of sheets over a completed stack is facilitated.

Another object of this invention is to improve the aforedescribed method of stacking cardboard sheets whereby the stack change can be effected without loss of sheets or damage thereto.

Still another object of the invention is to provide an improved apparatus for this purpose.

SUMMARY OF THE INVENTION

These objects and others which will become apparent hereinafter are attained, in accordance with the method of the present invention, wherein the shingled sheets, especially from a cross-cutting machine, are displaced in a feed direction along a transport path, the method comprising the steps of:

(a) successively depositing the sheets fed in the feed direction upon a raisable and lowerable sheet-collection platform disposed along the path to form an original stack while progressively lowering the platform;

(b) while continuing to feed the sheets toward the platform and upon attainment of a certain stack height, rapidly lowering the platform with the stack;

(c) upon rapid lowering of the platform, inserting horizontally in the feed direction between oncoming sheets to be stacked and a top of the stack a vertically fixed grate upon which a collection of the continuously fed oncoming sheets is formed;

(d) during insertion of the grate horizontally between the oncoming sheets and the top of the stack, vibrating the collection of sheets in the feed direction and counter to the direction, whereby a new stack is formed on the grate; and (e) removing the original stack from the platform, transferring the new stack to the platform and withdrawing the grate from between the platform and the new stack.

In its apparatus terms, the apparatus comprises:

feed means for advancing sheets to be stacked along a transport path in a feed direction;

a raisable and lowerable platform disposed at a stacking location along the path, receiving the sheets in succession and forming an original stack of the sheets on the platform, the platform progressively lowering as the original stack is formed thereon;

means for rapidly lowering the platform upon attainment of a certain stack height;

a vertically fixed bar grate displaceable horizontally and insertable in the feed direction upon rapid lowering of the platform between oncoming sheets to be stacked and a top of the stack, thereby forming on the grate a collection of the continuously fed oncoming sheets; and means for vibrating the collection of sheets in the feed direction and counter to the direction during insertion of the grate horizontally between the oncoming sheets and the top of the stack, whereby a new stack is formed on the grate, whereby upon removing of the original stack from the platform, transferring of the new stack to the platform and withdrawing the grate from between the platform and the new stack, the new stack can be built to a certain stack height.

By vibrating the partial stack as it is formed on the bar grate, the friction between this partial stack and the bar grate is so reduced, in spite of the progressive increase in the weight of the partial stack from continuously accumulating oncoming sheets, that the bar grate can be moved across the full width of the finished stack without interrupting the feed of the sheets. The vibration allows the sheets engaging the stop board with their leading edges to partially move in the opposite direction and thereby reduce the frictional stress on the lowermost sheet of the newly formed stack against the bar grate.

Another advantage of the invention is that the quality of the stack produced is improved since the sheets at the lower portion of the stack, which are stacked intermediately on the bar grate, are edge-aligned.

According to the invention the collection of sheets is vibrated in step (d) by vibrating a stop board against which leading edges of the sheets engage upon stacking on the platform and the grate.

In still another feature of the invention the grate is advanced in a stepwise manner with cyclical partial retraction in each step at least during a terminal part of the insertion of the grate in step (d).

In still a further feature the method can include the step of raising the original stack during the terminal part of the insertion of the grate in step (d) to lift sagging leading edges of the collection of oncoming sheets.

More specifically, the means for vibrating includes a stop board in the path engageable by leading edges of the sheets as the sheets arrive at the location, and vibrating means for imparting to the stop board vibrations in the direction and counter to the direction during insertion of the grate horizontally between the oncoming sheets and the top of the stack.

The stop board has a forward portion engageable by the leading edges, a rearward portion, elastic damper elements connecting the forward and rearward portions, one of the portions being movable in and counter to the feed direction and the vibrating means being mounted on the rearward portion.

Advantageously the forward portion is suspended from the rearward portion by the elastic damper elements, the vibrating means acts upon the one of the portions at a lower part thereof above the grate, and a further elastic element connects the forward and rearward portions between a region at which the forward portion is suspended from the rearward portion and the lower part.

The forward portion of the stop board can be provided with a low-friction coating on a side thereof engageable by the leading edges of the sheets.

The vibration of the stop board is advantageous because it allows conventional elements to be used for the vibration of the partial stack and thus permits equipping conventional stacking systems with the invention.

The cyclical advance of the bar grate which can involve a forward movement followed by a number of interruptions of advance, a smaller rearward movement and a brief interruption before the next advance, ensures that an impact of the bar grate with a leading edge of the underlying sheet will be minimized. The partial retraction is not essential in all cases.

The elevation of the stack to support the leading edges of the new stack, coupled with vibration has been found to be especially effective for thinner sheets which may be sensitive to the engagement of the tips of the bars of the bar grate with the lowermost sheet or sheets of the newly formed stack which can be raised by the advancing bar grate without frictional retardation of this upward movement.

BRIEF DESCRIPTION OF THE DRAWING

The above and other objects, features and advantages of the invention will become more readily apparent from the following description, reference being made to the accompanying highly diagrammatic drawing in which.

SPECIFIC DESCRIPTION

Figure 1:
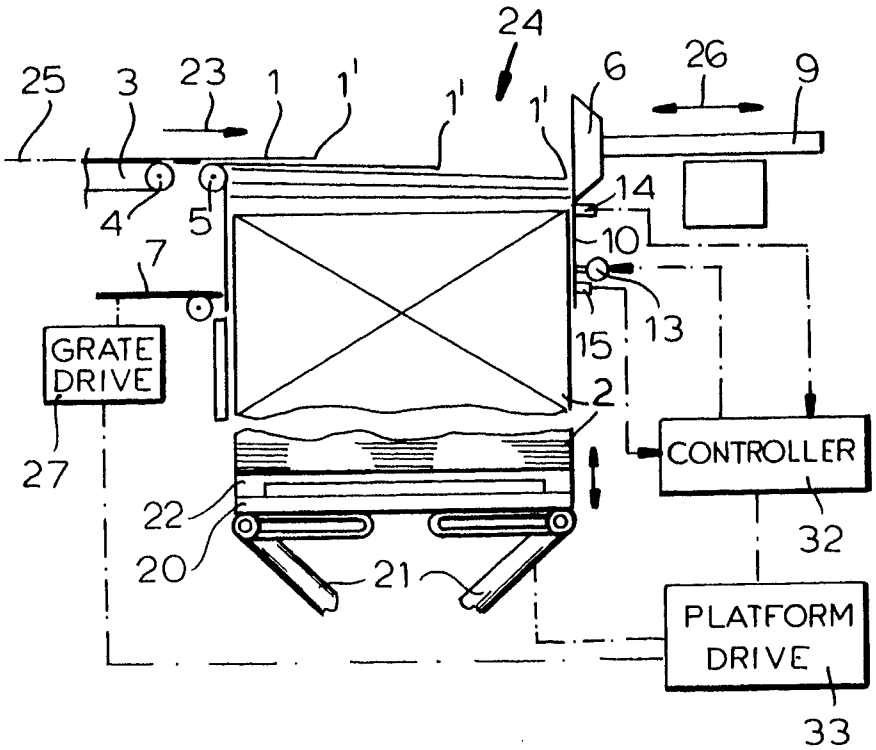
Figure 4:
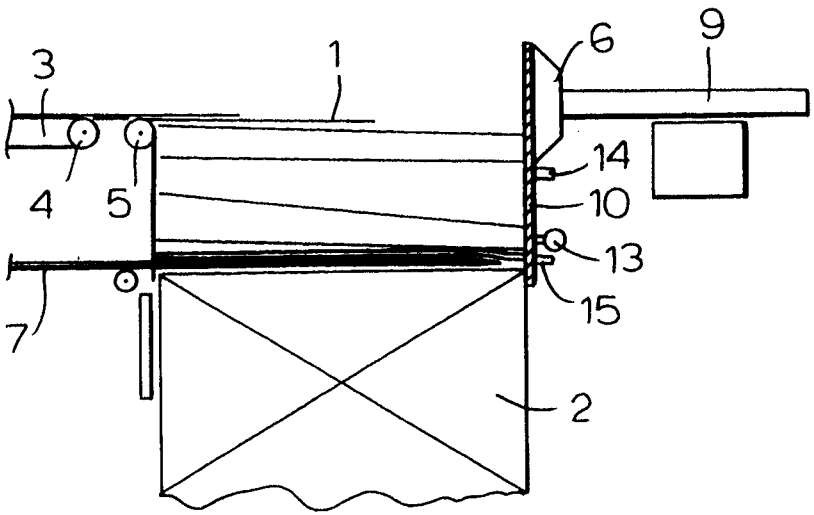
Figure 3:
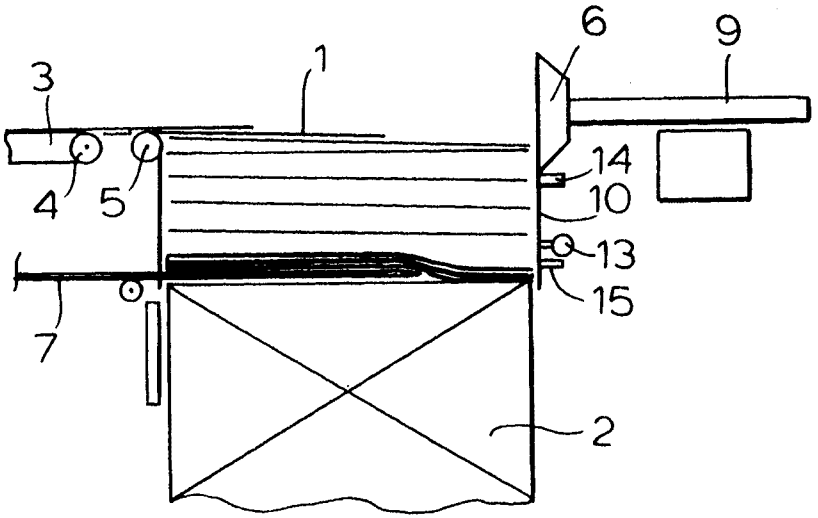

The stacking apparatus shown in FIGS. 1–4 serves for the stacking of a succession of cardboard sheets 1 supplied continuously in a shingled stream, i.e. with one sheet overlapping the previous sheet as will be apparent from FIG. 1. The stack which is formed has been represented at 2 in these Figures. The apparatus is assumed to be at the downstream end of a cross-cutting machine which severs the sheets from a continuous web.

The stack 2 is vertically displaceable on a collection platform 20 which can be raised and lowered on a scissor linkage 21, for example, and can carry a pallet 22 upon which the stack 2 is formed.

The sheets 1 are fed in a sheet-feed direction 23 by a belt conveyor 3 having a deflection roller 4 at its discharge side. A final impetus to the sheets can be given by the roller 5 fixedly located at the stacking location 24, at the maximum stack height. The roller 5 may be driven at a higher speed than the belt conveyor 3 and the feed plane is represented at 25 in FIG. 1.

To align the leading edges 1' of the sheets, upon depositing the sheets in the stack, at the end of the transport path for the sheets is a stop board 6 which can extend transversely over the working width of the apparatus and is vertically fixed or adjustable to different sheet lengths (sheet formats) on a support 9 which can be moveable horizontally as represented by the arrow 26.

Figure 5:
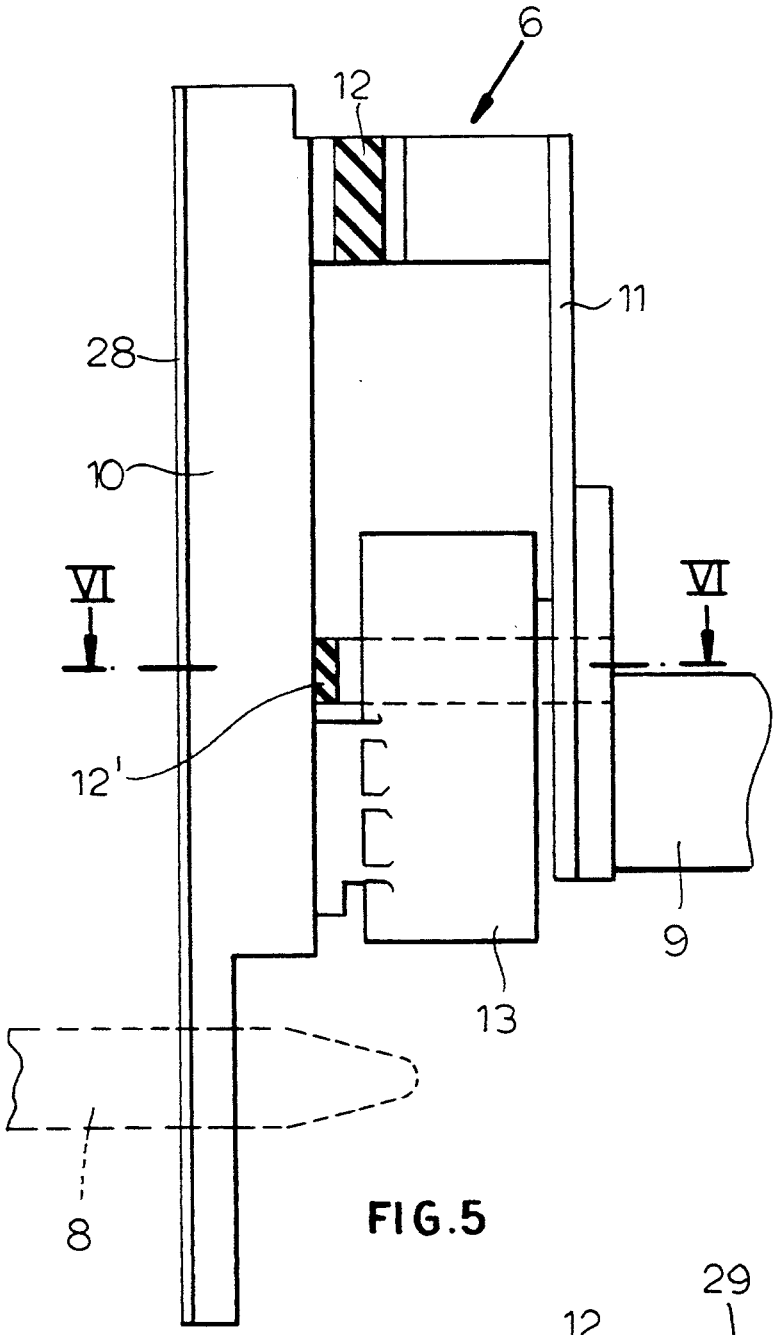
FIG. 5 is an enlarged elevational view, partially in longitudinal section in the sheet feed direction of the stop board assembly provided with its vibrator.

The construction of the stop board 10 and its mounting has been shown in greater detail in FIG. 5.

Below the belt conveyor 3, about 250 mm below the feed plane 25, in the machine frame (not shown) upstream of the stacking location 24, a bar grate 7 is provided. The bar grate 7 is vertically fixed and horizontally displaceable by a grate drive 27. The bars 8 of the grate form a collecting surface for oncoming sheets when the bar grate is inserted between the stack 2 and such oncoming sheets so that the sheets form a collection or new stack on the grate 7. The bars 8 are mutually parallel and transversely spaced apart to define the collection surface.

The sheets 1 are thus intermediately stacked upon the bar grate 2 while a finished stack 2 is lowered, removed from the stack location 24 on the pallet 22 and a new pallet is placed upon the platform 20. The new platform is raised to a point just below the bar grate 7 and the bar grate can then be withdrawn to the left to deposit the partial stack 9 formed thereon upon this latter pallet.

The stop board 6 extends in the vertical direction from a region above the feed plane 25 to a location below the bar grate 7. At its lower portion in the region of the bars 8, it is formed with cutouts through which the tips of the bars 8 can pass as can be seen from FIG. 5, especially upon the stacking of short sheets.

Preferably the stop board 6 is subdivided into individual segments across the working width or the machine width so that two or more stacks of different sheet length can be simultaneously formed next to one another.

The stop board 6 or its individual segments are mounted at the end of an adjustment bar 9 which provides adjustment to sheet length and is horizontally shiftable in the machine frame approximately at the level of the belt conveyor 3 in and counter to the sheet-feed direction 23.

The stop board can have imparted to it a horizontal vibration in and counter to the sheet-feed direction.

Figure 6:
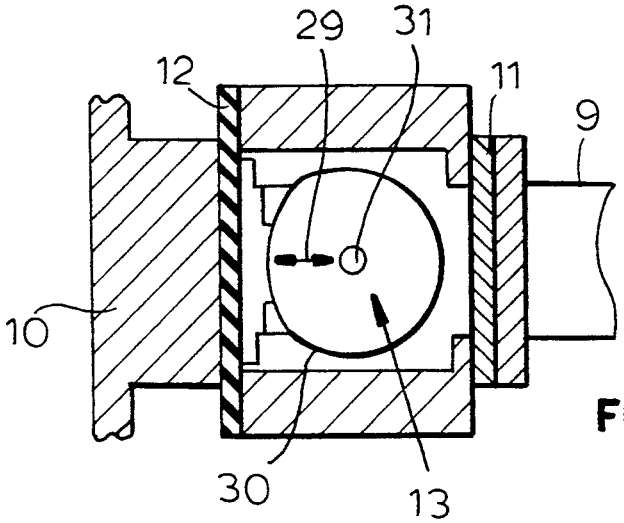
FIG. 6 is a section taken along line VI—VI of FIG. 5.

For that purpose, as is apparent from FIGS. 5 and 6, the stop board can comprise a forward part 10 connected to a rearward part 11 and parallel thereto but spaced therefrom. The rearward part 11 can be mounted upon the adjustment bar 9.

The forward portion 10 can be provided with a layer or coating 28 (FIG. 5) of a low friction material, for example polytetrafluoroethylene.

The forward portion 10 is suspended from the rearward portion 11 by elastic rubber damping elements 12.

At its lower portion (for example about 250 mm) below the resilient suspension and above the grate 7, a vibrator 13 acts upon the forward portion 10 to generate the horizontal vibration which has been represented by the double-headed arrow 29 in FIG. 6. The vibrator 13 can have a cam disk 30 rotatable about a vertical axis on a shaft 31 by a motor (not shown) although other types of electromagnetic vibrators may be used.

When an eccentric system forms the vibrator, the eccentricity can be adjustable to vary the oscillation amplitude, e.g. by changing the cam, the rotary speed controlling the oscillation frequency.

The damper elements can be located at two levels, e.g. as elastic elements 12 forming the suspension and a further elastic or rubber damping element 12' at about 100 mm lower, e.g. in the region between the suspension and the point of attack of the vibrator 13 on the forward portion 10.

The longitudinal edges of the sheets can be guided by vertical lateral guide plates (not shown) and which are located at the machine side and between pairs of which a stack 2 can be formed. These plates can extend in the sheet-feed direction.

The apparatus further can include a sensor 14, for example, a capacitative sensing head which can detect the height of the upper edge of the stack to control the vertical movement of the collecting platform 20. This sensor 14 can be located just below the feed plane 25.

The second sensor 15 can be located about 40 mm above the bar grate 7.

The sensors 14 and 15 provide inputs through the controller 32 which can operate the platform drive 33 and the grate drive 27, as well as the vibrator 13.

As can be seen from FIG. 1, the sheets 1 are deposited upon the stack 2 on the pallet 22. The bar grate 7 is withdrawn to the left into a waiting position. While the sheets 1 are continuously fed to the stacking region, the stack 2 is continuously lowered to maintain the fall height of the sheets upon the stack 2 substantially constant. The control of the height is effected by means of the sensor 14. When the stack 2 has the desired height, i.e. when a predetermined number of sheets 1 have been deposited in the stack, a stack-change operation is initiated.

The initial step is a rapid lowering of the stack 2, i.e. a lowering at high speed, until the upper edge of the stack reaches the sensor 15.

Figure 2:
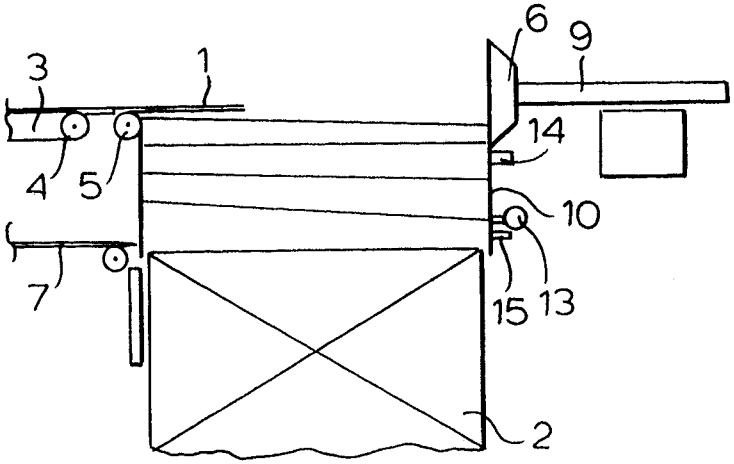
FIGS. 1–4 are highly diagrammatic side elevational views illustrating successive steps in the method of the invention.

The lowering movement is then slowed until the upper edge of the stack is about 50 mm below the bars 8 of the bar grate 7 (FIG. 2).

The sheets 1 are continuously fed during this lowering of the stack so that the rapid lowering will fan out the rear edges of the sheets 1 to enable to bar grate 7 to be inserted between the oncoming sheets and the completed stack.

The bar grate 7 is advanced across the top of the stack as soon as the upper edge of the stack is lowered beneath the bar grate. Simultaneously, a vibration of the front portion 10 of the stop board 6 is initiated by setting into rotation the eccentric elements of the vibrator 13.

The vibrating movement imparts to the partial stack a horizontal vibration in a counter to the sheet-feed direction. It has been found that an appropriate vibration is applicable with a frequency of 60 to 70 Hz when the damping elements 12 are composed of hard rubber, the eccentric disk or cam 30 being driven at this rate.

Depending upon the format length which can be between 500 mm and 1800, the bar grate 7 can be advanced initially at a speed of about 120 mm/s until it extends between about 50 to 75% of the format length across the stack 2. During this movement, the rear edges of the oncoming sheets 1 deposit upon the bar grate. The vibration reduces the friction between the new stack being formed on the bar grate and the bars of the latter so that the bar grate can be advanced across the entire width of the stack without compacting or damaging the oncoming sheets.

After the continuous initial advance of the bar grate 7, the latter can receive a stepwise movement in which advances alternate with standstill for the balance of the format width. It has been found that this stepwise movement of the bar grate allows it to pass without problems between the leading edge part of the new stack and the previously formed stack. A cyclical movement can be imparted to the bar grate during this period to, for example, follow each advance step by a shorter retraction.

It has been found to be advantageous, especially with thin types of cardboard of lesser stiffness, to be advantageous toward the end of the bar grate insertion to raise the stack 2 so as to lift in sagging leading edge portions of the partial stack by such movement through 10 to 40 mm immediately ahead of the stop board 6 and thereby facilitate the movement of the bar grate across the top of the stack.

The horizontal movement of the bar grate 7 is halted when the stop board 6 is reached.

The upper pallet of the stack 2 is then completely separated from the lower part.

Next the lower part of the stack is rapidly lowered and transported away on its pallet, a new pallet is placed upon the collection platform and the latter is raised until the new pallet is just below the bar grate 7. During these operations, the partial stack grows upon the bar grate 7 continuously but does not reach the height of the feed plane. Then the bar grate 7 is redirected horizontally to the left to transfer the partial stack onto the new pallet. When the stack 2 reaches the upper sensor 14, the platform is continuously lowered as the new stack grows. When the stack 2 reaches the desired size, the process is repeated.

We claim:

1. A method of stacking ragged sheets, especially of cardboard, displaced in a feed direction along a transport path, said method comprising the steps of: (a) successively depositing said sheets fed in said direction upon a raisable and lowerable sheet-collection platform disposed along said path to form an original stack while progressively lowering said platform;

(b) while continuing to feed said sheets toward said platform and upon attainment of a certain stack height, rapidly lowering said platform with said stack;

(c) upon rapid lowering of said platform, inserting horizontally in said direction between oncoming sheets to be stacked and a top of said stack a vertically fixed grate upon which a collection of the continuously fed oncoming sheets is formed;

(d) during insertion of said grate horizontally between said oncoming sheets and said top of said stack, vibrating said collection of sheets in said direction and counter to said direction by vibrating a stop board against which leading edges of said sheets engage upon stacking on said platform and said grate, whereby a new stack is formed on said grate, said grate being advanced in a stepwise manner with cyclical partial retraction in each step at least during a terminal part of the insertion of said grate in step (d), and raising said original stack during said terminal part of the insertion of the grate in step (d) to lift sagging leading edges of said collection of oncoming sheets; and (e) removing said original stack from said platform, transferring said new stack to said platform and withdrawing said grate from between said platform and said new stack.

2. An apparatus for stacking sheets, especially of cardboard, comprising:

feed means for advancing sheets to be stacked along a transport path in a feed direction;

a raisable and lowerable platform disposed at a stacking location along said path, receiving said sheets in succession and forming an original stack of said sheets on said platform, said platform progressively lowering as said original stack is formed thereon;

means for rapidly lowering said platform upon attainment of a certain stack height;

a vertically fixed bar grate displaceable horizontally and insertable in said direction upon rapid lowering of said platform between oncoming sheets to be stacked and a top of said stack, thereby forming on said grate a collection of the continuously fed oncoming sheets; and means for vibrating said collection of sheets in said direction and counter to said direction during insertion of said grate horizontally between said oncoming sheets and said top of said stack, whereby a new stack is formed on said grate, whereby upon removing of said original stack from said platform, transferring of said new stack to said platform and withdrawing said grate from between said platform and said new stack, said new stack can be built to a certain stack height, said means for vibrating including a stop board in said path engageable by leading edges of said sheets as said sheets arrive at said location, and vibrating means for imparting to said stop board vibrations in said direction and counter to said direction during insertion of said grate horizontally between said oncoming sheets and said top of said stack, said stop board having a forward portion engageable by said leading edges, a rearward portions, elastic damper elements connecting said forward and rearward portions, one of said portions being movable in and counter to said feed direction and said vibrating means being mounted on said rearward portion.

3. The apparatus defined in claim 2 wherein said forward portion is suspended from said rearward portion by said elastic damper elements, said vibrating means acts upon said one of said portions at a lower part thereof above said grate, and a further elastic element connects said forward and rearward portions between a region at which said forward portion is suspended from said rearward portion and said lower part.

4. The apparatus defined in claim 3 wherein said forwards portion is provided with a low-friction coating on a side thereof engageable by said leading edges.

5. The apparatus defined in claim 2, further comprising means for advancing said grate in a cyclical stepwise manner in each step at least during a terminal part of the insertion of said grate horizontally between said oncoming sheets and said top of said stack.

6. An apparatus for stacking sheets, especially of cardboard, comprising:

feed means for advancing sheets to be stacked along a transport path in a feed direction;

a raisable and lowerable platform disposed at a stacking location along said path, receiving said sheets in succession and forming an original stack of said sheets on said platform, said platform progressively lowering as said original stack is formed thereon;

means for rapidly lowering said platform upon attainment of a certain stack height;

a vertically fixed bar grate displaceable horizontally and insertable in said direction upon rapid lowering of said platform between oncoming sheets to be stacked and a top of said stack, thereby forming on said grate a collection of the continuously fed oncoming sheets;

means for vibrating said collection of sheets in said direction and counter to said direction during insertion of said grate horizontally between said oncoming sheets and said top of said stack, whereby a new stack is formed on said grate, whereby upon removing of said original stack from said platform, transferring of said new stack to said platform and withdrawing said grate from between said platform and said new stack, said new stack can be built to a certain stack height; and means for raising said original stack during said terminal part of the insertion of the grate horizontally between said oncoming sheets and said top of said stack to lift sagging leading edges of said collection of oncoming sheets.

* * * * *